US005164636A

United States Patent [19]

Allaire

[11] Patent Number: 5,164,636

[45] Date of Patent: Nov. 17, 1992

[54] ACTUATOR FOR FLASHING LIGHT

[75] Inventor: Michel Allaire, Montreal, Canada

[73] Assignee: Societe de Transport de la Communaute Urbaine de Montreal, Montreal, Canada

[21] Appl. No.: 708,983

[22] Filed: May 31, 1991

[51] Int. Cl.[5] ..... H05B 37/00

[52] U.S. Cl. ..... 315/200 A; 315/208; 315/209 R; 315/215

[58] Field of Search ..... 315/241 R, 200, 208, 315/209, 215, 225, 241

[56] References Cited

U.S. PATENT DOCUMENTS

| | | | |
|---|---|---|---|
| 3,493,927 | 9/1967 | Effenberger . | |
| 3,870,924 | 3/1975 | Helmuth | 315/200 |
| 4,156,166 | 5/1979 | Shapiro | 315/200 |
| 4,160,235 | 7/1979 | Krumrein | 315/200 |
| 4,173,013 | 10/1979 | Spiteri . | |
| 4,876,526 | 10/1989 | Spiteri . | |

*Primary Examiner*—Eugene R. LaRoche
*Assistant Examiner*—R. A. Ratliff
*Attorney, Agent, or Firm*—Fishman, Dionne & Cantor

[57] ABSTRACT

The actuator is connected in series between the power supply and the flashing light. It includes a switch which is connected in series between the power supply and the flashing light so that when the switch is closed the light turns on and when the switch is open the light is turned off. A comparator controls the opening and closing of the switch at a frequency determined by an RC timer. Also, the duty cycle of the flashing light is controlled by the timer. A current overload protector lowers the duty cycle of the flashing light as the magnitude of the overload is increased and, in the event of a short circuit, decreases the duty cycle to approximately zero.

7 Claims, 5 Drawing Sheets

ACTUATOR FOR FLASHING LIGHT

BACKGROUND OF INVENTION

1. Field of the Invention

The invention relates to an actuator for flashing lights such as directional or emergency lights for vehicles. More specifically, the invention relates to a two-wire, electronic actuator.

2. Description of Prior Art

In the earliest approach, such actuators included two-wire electro-mechanical relays connected in series with both the power supply and the load (the flashing light). The relays were controlled by a timing device to close and open at a predetermined frequency, and, by applying power to the lights when the relay was closed, and removing power when the relay was open, the flashing light was caused to flash.

It is presently desirable to replace such relay-inclusive actuators with electronic actuators using semiconductor elements. Such electronic actuators have been developed but, typically, they comprise three-wire devices, i.e., two wires for connecting the actuators in parallel with the power supply and a third wire connected to the flashing light. Thus, in replacing the relay-inclusive actuators of presently existing vehicles, it is not simply a matter of removing the present actuator and replacing it with an electronic actuator. Instead, it is necessary to add a ground terminal to accept the three-wire replacement for the two-wire actuator.

In addition, electronic actuators are illustrated in U.S. Pat. No. 3,493,927, Effenberger, U.S. Pat. No. 4,173,013, Spiteri(1) and U.S. Pat. No. 4,876,526, Spiteri (2). The Effenberger patent teaches a system for connecting flashing lights to indicate direction by selection of the appropriate flashing light. Spiteri(1) teaches an actuator which uses an operational amplifier to increase the intensity and the life of the flashing lights. The Spiteri(2) teaches an actuator wherein the flashing frequency is controlled by a CMOS oscillator whose frequency is independent of the frequency of the power supply.

SUMMARY OF INVENTION

It is therefore an object of the invention to provide an actuator as above described which comprises a two-wire, electronic actuator.

It is a further object of the invention to provide such an electronic actuator which uses semiconductor elements.

It is a still further object of the invention to provide such an electronic actuator which includes current overload protection.

It is a still further object of the invention to provide such an actuator wherein the duty cycle of the actuator is decreased according to the amount of overload.

In accordance with the invention, the actuator includes a switch means in series between the power supply and the flashing light. The actuator further includes a switch control means for opening and closing the switch means, and a timer means for controlling the frequency of the switch control means, and also, the duty cycle of the flashing light.

Also in accordance with the invention, the actuator includes means for comparing the flashing light driving current with a reference and for decreasing the duty cycle of the actuator in accordance with the amount of current overload.

In accordance with a particular embodiment of the invention there is provided an actuator for a flashing light, said actuator being connectable in series between a power supply and said flashing light;

said actuator comprising:

switch means connected in series between said power supply and said flashing light, whereby, when to said flashing light to turn said flashing light on, and when said switch means is open, said driving signal is not applied to said flashing light so that said flashing light is off;

switch control means for controlling the opening and closing of said switch means; and timer means for controlling the frequency of said switch control means and, also, the duty cycle of said flashing light.

BRIEF DESCRIPTION OF DRAWINGS

The invention will be better understood by an examination of the following description, together with the accompanying drawings, in which.

DESCRIPTION OF PREFERRED EMBODIMENTS

Figure 1:
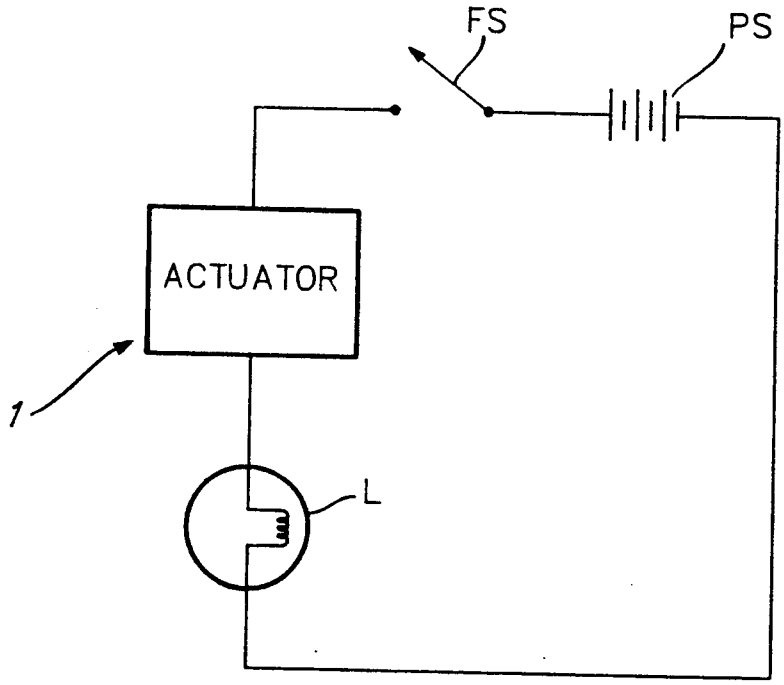
FIG. 1 is a very general block diagram of the actuator installed in a flashing light system in accordance with the invention.

As seen in FIG. 1, the actuator, indicated generally at 1, is connected in series between the power supply PS, illustrated in FIG. 1 as a battery, and the flashing light L. As can be seen, the actuator is not connected to ground so that it offers better resistance to overvoltage which can appear in the battery. In addition, it is naturally protected against reversals of polarity because of the intrinsic and normally back biased diode part of the MOSFET transistor of which the power switch is made. FS is the flashing light ON/OFF switch means.

Figure 2:
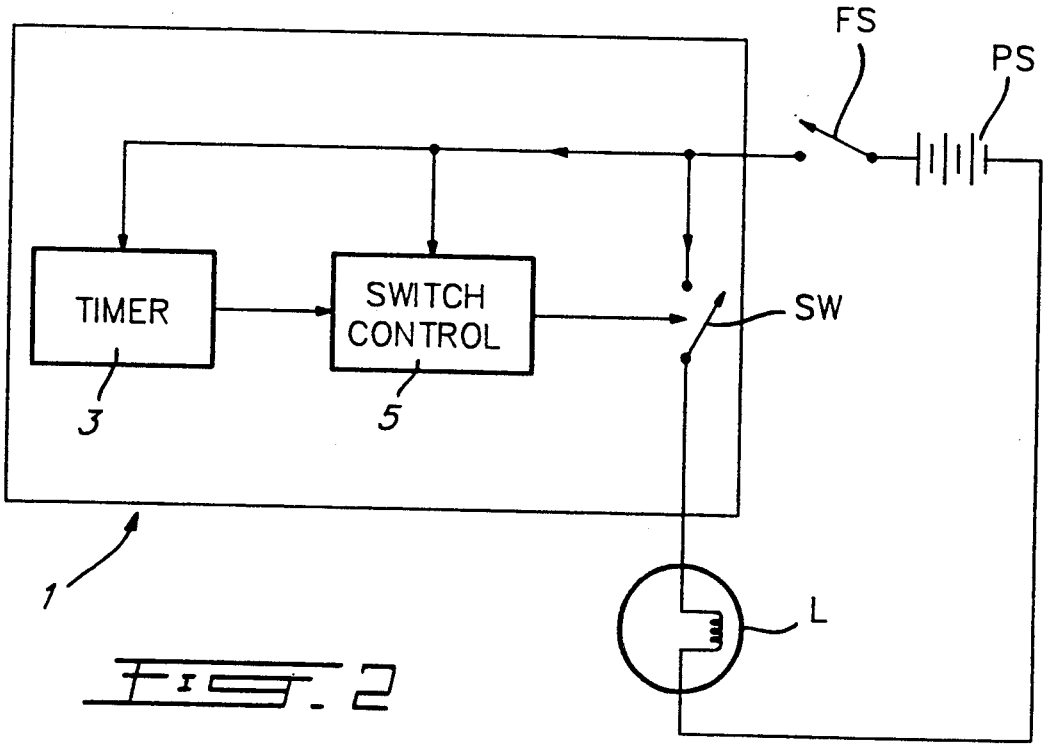
FIG. 2 is a more detailed block diagram of the flashing light system including further elements of the actuator in accordance with the invention.

Turning to FIG. 2, it can be seen that the actuator 1 includes a timer means 3 and a switch control means 5 for controlling the flashing light power switch means SW. The timer means 3 controls the frequency and duty cycle of the switch control means 5.

As seen in FIG. 2, when FS is closed and SW is closed, then power will be applied to the light L to turn the light on. When switch means SW is open, power is not applied to the light L so that the light is turned off. The light is turned on and off, i.e., flashes, at a duty cycle and frequency determined by the timer means 3.

Figure 3:
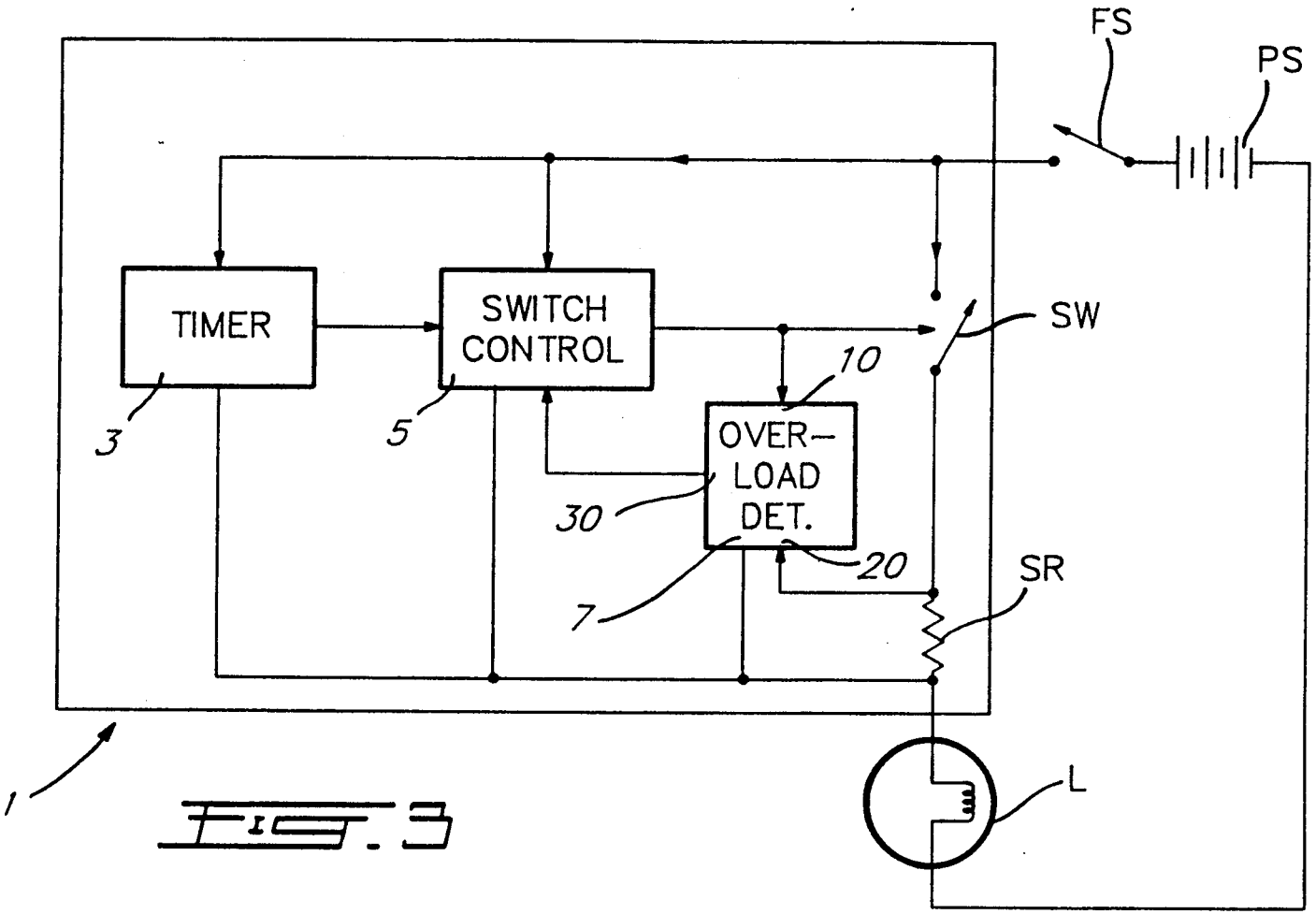
FIG. 3 is a block diagram similar to FIG. 2 but also including the current overload protection arrangement.

Turning now to FIG. 3, there is illustrated, in addition to the elements illustrated in FIG. 2, a current overload detector 7. The overload detector comprises a sensing resistor SR and a comparator having a reference input terminal 10 and a signal input terminal 20. The output terminal 30 of detector 7 is connected to the switch control means 5 for reasons to be discussed below. As can be seen, the reference signal is derived from the switch control output means 5; this reference signal approximates the wave shape of the first cycle of the input current to the lamp; it is in fact somewhat higher in order to let the initial current through. The signal input terminal is fed with a signal proportional to the current which drives the lamp L. When this signal exceeds the value of the reference signal, then the overload detector provides a signal to the switch control means 5 to turn off the switch control means.

Figure 4:
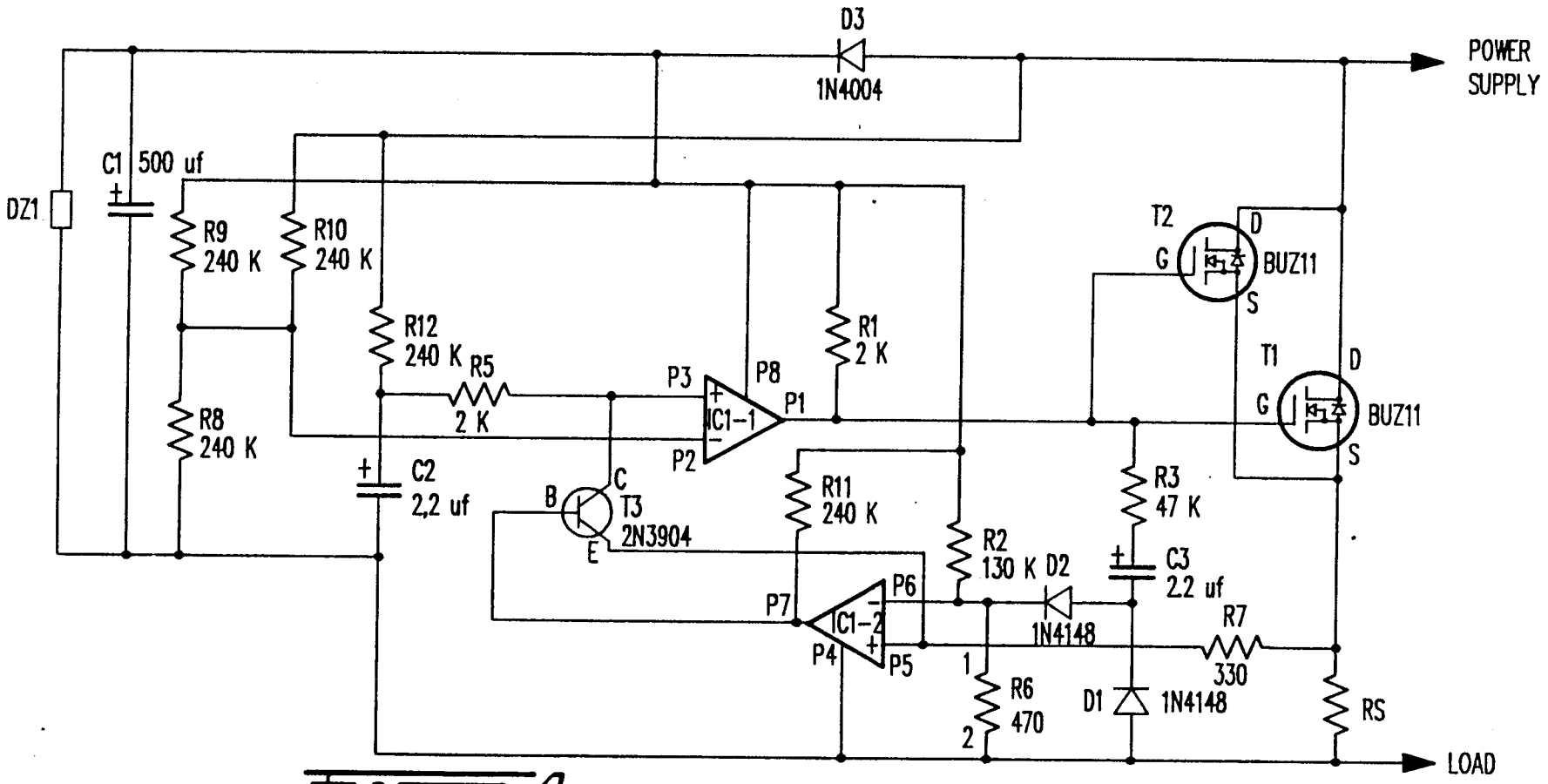
FIG. 4 is a circuit diagram of an actuator in accordance with the invention.

Turning now to FIG. 4, the timer means 3 is formed by resistor R12 and capacitor C2 forming an RC timing network. The switch control means comprises the comparator ICl-1 having a positive input terminal P3 and a negative input terminal P2. The output terminal of ICl-1 is P1.

The junction of the RC network is connected to P3, while the power supply, comprising a 13.8 volt battery, is connected to terminal P2 through voltage dividing networks R9 and R8. Resistor R10 brings a positive hysteresis to P2.

The switch means SW is formed from transistors T1 and T2 which, in the illustrated embodiment, are in parallel. As seen, the transistors are connected in series between the lamp L and the power supply.

The overload detector is formed from the comparator ICl-2 having a positive input terminal P5, a negative input terminal P6 and an output terminal P7. The output P7 is connected to the base of transistor T3 whose collector is connected to input terminal P3 of ICI-1, and whose emitter is connected to the input terminal P5 of ICl-2.

Figure 5:
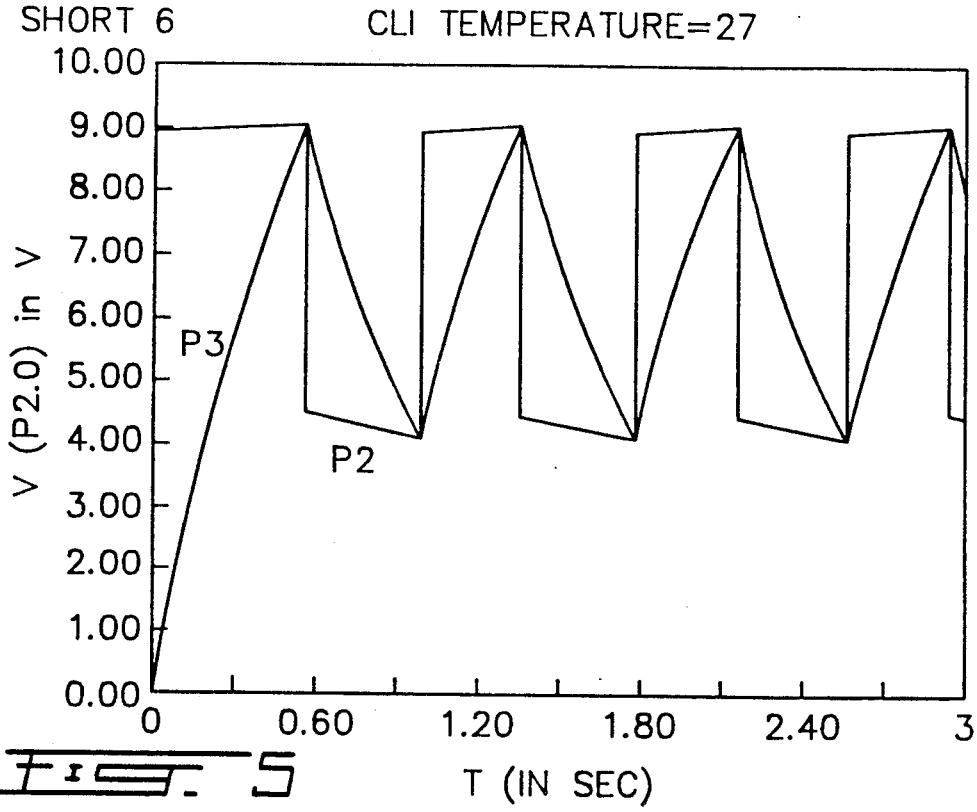
FIG. 5 is a graph of voltages appearing at pins 2 and 3 of ICI-1 in FIG. 4 which voltages are measured with reference to the output of the actuator.
Figure 6:
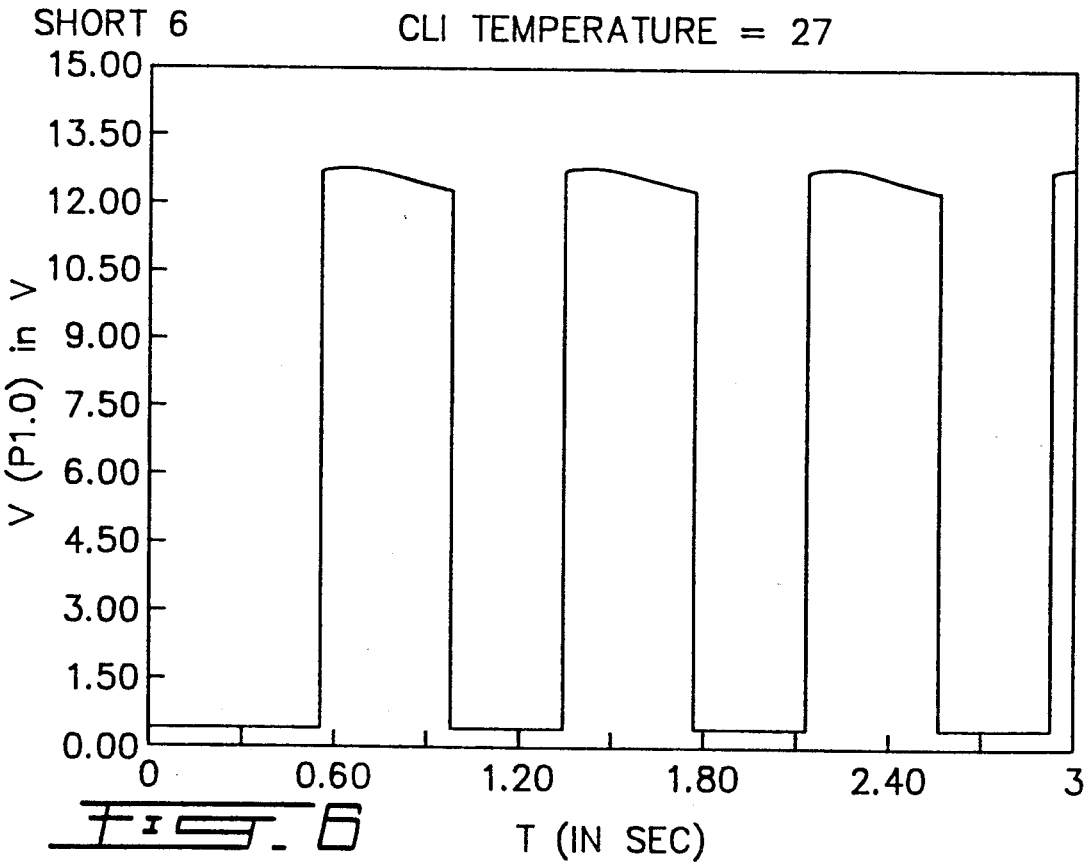
FIG. 6 is a graph of the output at pin 1 of ICI-1 in FIG. 4 which voltages are measured with reference to the output of the actuator.

To understand the operation of the actuator, reference is had to FIGS. 4, 5 and 6. As seen in FIG. 6, initially, the signal on P1 is low. When a switch such as FS is turned on, the capacitor C1 is rapidly charged through the diode D3 and the lamp. C1, an energy reservoir, will become the internal power supply of the flasher during the "ON" time of the actuator. This reservoir is refilled during the "OFF" time of the actuator. Thus, power is applied to the actuator and a voltage is applied to P2 through the voltage divider network. In the illustrated embodiment, the applied voltage is approximately two-thirds of the battery voltage, that is, approximately nine volts. The voltage at P3 will start at 0 and will charge up at a rate determined by the RC circuit, R12C2. When the voltage at P3 is equal to the voltage at P2, then the comparator is turned on and the output of P1 goes high as seen in FIG. 6. At the same time, because the to about half its previous voltage, that is, approximately 4.5 volts. Capacitor C2 will now begin to discharge through resistor R12 at a rate determined also by the RC circuit R12C2, and the discharge across C2 will continue until such time as the voltage at P3 is equal to the voltage at P2. At this time, IC1-1 will turn off so that the voltage at P1 will again go low, as seen in FIG. 6. The voltage at P3 will once again rise to the nine volt level, as seen in FIG. 5, and capacitor C2 will once again begin to charge up through resistor R12.

When IC1-1 is turned on, transistors T1 and T2 will also be turned on so that lamp L will be turned on by a signal provided by the battery PS.

Figure 7:
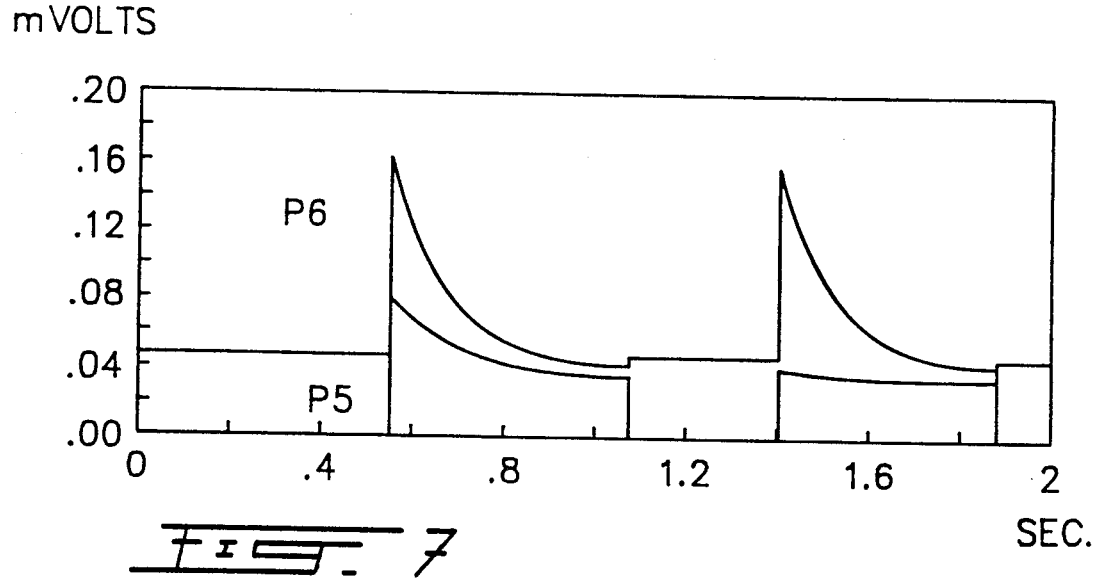
FIG. 7 is a graph of the voltages appearing at pins 5 and 6 of ICI-2 of FIG. 4 under normal, non-overload conditions which voltages are measured with reference to the output of the actuator.

Turning now to the operation of the current overload detector, the normal output at P7 is low. As seen in FIG. 7, the signal applied to P6 is derived from the square wave at P1, which is transformed by R3, C3, D2, R6 and R2. The signal applied at P5 will be of the same shape as the current in the power switch since it is produced by the ohmic drop of this current in the resistor Rs. Under non-overload conditions, the signal at P6 will be greater than the signal at P5 so that the signal on P7 will remain low.

Figure 8:
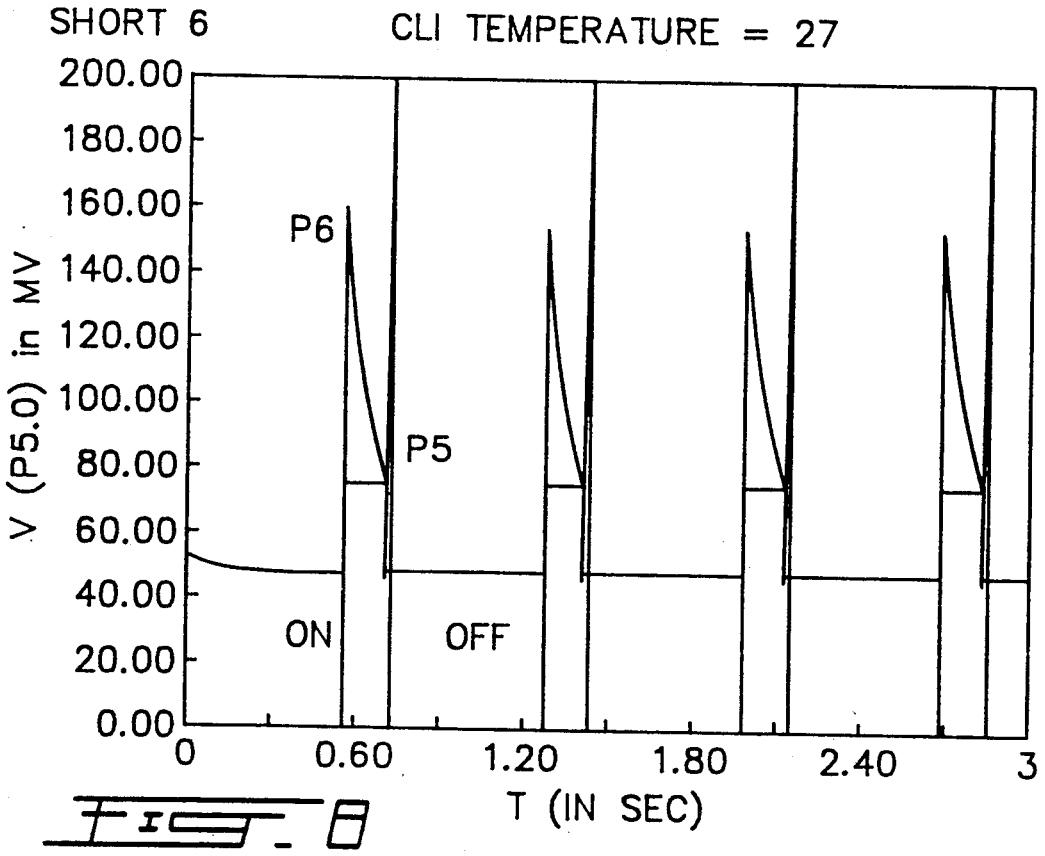
FIG. 8 is a graph of the voltages appearing at pins 5 and 6 of ICl-2 of FIG. 4 under overload conditions which voltages are measured with reference to the output of the actuator.

The situation in the event of an overload is illustrated in FIG. 8. As can be seen, when the signal at P5 reaches the level of the signal at P6, then IC1-2 will be turned on and P7 will go high turning on transistor T3. At this time, the collector of T3 will and the output at P1 will go low. Also, capacitor C2 is discharged rapidly and completely through R5, T3, R7 and Rs. This is illustrated in FIG. 8 where P6 is shown as going down. Thus, the transistors T1 and T2 will be turned on only during the interval identified at ON at FIG. 8, i.e., the duty cycle of the flashing rate will be reduced. In fact, as can be seen in FIG. 8, if there should be a short circuit, then the duty rate will be reduced to near 0 so that there will be approximately no power dissipated whatsoever during a short circuit. Of course, the lamp will not be flashing at this time.

Resistor R7 provides positive feedback to point P5 in order to completely discharge C2. The power switch will be ON again, when the voltage at C2 reaches the voltage at P2 (approximately 9 volts).

It can be seen that the inventive actuator is a two wire device so that it can be placed in the physical location presently occupied by relays in vehicles such as cars, buses and trucks. In addition, it can be seen that the power dissipation is actually of a short circuit, will actually fall to 0.

Although particular embodiments have been described, this was for the purpose of illustrating, but not limiting, the invention. Various modifications, which will come readily to the mind of one skilled in the art, are within the scope of the invention as defined in the appended claims.

I claim:

1. An actuator for a flashing light, said actuator being connectable in series between a power supply and said flashing light;

said actuator comprising:

switch means connected in series between said power supply and said flashing light, whereby, when said switch means is closed, a driving signal is applied to said flashing light to turn said flashing light on, and when said switch means is open, said driving signal is not applied to said flashing light so that said flashing light is off;

switch control means for controlling the opening and closing of said switch means; and timer means for controlling the frequency of said switch control means and, also, the duty cycle of said flashing light;

said switch means having a first terminal and a second terminal;

said switch control means having a first terminal and a second terminal;

said timer means having a first terminal and a second terminal;

said first terminals of said switch means, said switch control means and said timer means being connected to a first common point;

said second terminals of said switch means said switch control means and said timer means being connected to a second common point;

whereby, said actuator comprises a two-wire device, said first common point being connectable to said power supply and said second common point being connectable to said flashing light.

2. An actuator as defined in claim 1 and further including a current overload protection means comprising:

comparator means having a first input terminal, a second input terminal and an output terminal;

said first input terminal being connected to sense said driving signal;

said second input terminal being connected to a reference signal source;

said output terminal being connected to said switch control means to adjust said duty cycle such that, as the overload increases, said duty cycle decreases;

said comparator means further including a common point terminal;

said common point terminal of said comparator means being connected to said second common point.

3. An actuator as defined in claim 2 wherein said switch means comprises voltage controlled semi-conductor means;

said voltage controlled semi-conductor means including a first output terminal and a second output terminal;

said first output terminal of said voltage controlled semi-conductor means being connected to said first common point;

said second output terminal of said voltage controlled semi-conductor means being connected to said second common point.

4. An actuator as defined in claim 3 wherein said switch control means comprises a second comparator means having a first input terminal, a second input terminal and an output terminal;

said output terminal being connected to the control terminal of said voltage control semi-conductor means.

5. An actuator as defined in claim 4 wherein said timer means comprises an RC circuit;

the junction of said RC circuit being connected to said first input terminal of said second starter;

the power supply being connected to the second input terminal of said second comparator means through voltage divider means.

6. An actuator as defined in claim 5 and further including latching means for latching said current overload protection means to be turned off during an overload condition;

said latching means comprising a transistor having a control electrode connected to the output terminal of said comparator means;

a second terminal connected to the first input terminal of said second comparator means and a third electrode connected to the first input terminal of said comparator means.

7. An actuator as defined in claim 6 wherein said power supply comprises a battery.

* * * * *